US005889367A

United States Patent [19]

Hofmann et al.

[11] Patent Number: 5,889,367

[45] Date of Patent: Mar. 30, 1999

[54] LONG-LIFE HIGH POWERED EXCIMER LAMP WITH SPECIFIED HALOGEN CONTENT, METHOD FOR ITS MANUFACTURE AND EXTENSION OF ITS BURNING LIFE

[75] Inventors: Angelika Hofmann, Hanau; Silke Reber, Gelnhausen; Franz Schilling, Freigericht, all of Germany

[73] Assignee: Heraeus Noblelight GmbH, Hanau, Germany

[21] Appl. No.: 832,281

[22] Filed: Apr. 3, 1997

[30] Foreign Application Priority Data

Apr. 4, 1996 [DE] Germany ..... 196 13 502.8

[51] Int. Cl.[6] ..... H01J 61/06

[52] U.S. Cl. ..... 313/634; 313/607; 313/623

[58] Field of Search ..... 313/634, 623, 313/607

[56] References Cited

U.S. PATENT DOCUMENTS

| | | | |
|---|---|---|---|
| 4,870,323 | 9/1989 | Parks, Jr. et al. . | |
| 4,945,290 | 7/1990 | Eliasson et al. | 315/246 |
| 4,977,573 | 12/1990 | Bittenson et al. | 372/81 |
| 5,006,758 | 4/1991 | Gellert et al. | 313/634 |
| 5,173,638 | 12/1992 | Eliasson et al. | 313/634 |
| 5,194,740 | 3/1993 | Kogelschatz et al. | 250/492 |
| 5,386,170 | 1/1995 | Kogelschatz . | |
| 5,432,398 | 7/1995 | Kogelschatz | 313/25 |

FOREIGN PATENT DOCUMENTS

| | | |
|---|---|---|
| 0 344 732 | 12/1989 | European Pat. Off. . |
| 0 457 745 A2 | 11/1991 | European Pat. Off. . |
| 0 521 553 A2 | 1/1993 | European Pat. Off. . |
| 0 547 366 A1 | 6/1993 | European Pat. Off. . |
| 0 607 960 A1 | 7/1994 | European Pat. Off. . |
| 0 641 015 A2 | 3/1995 | European Pat. Off. . |
| 39 35 084 A1 | 4/1990 | Germany . |
| 39 07 277 A1 | 9/1990 | Germany . |
| 39 10 809 C2 | 10/1990 | Germany . |

*Primary Examiner*—Sandra O'Shea
*Assistant Examiner*—Matthew Gerike
*Attorney, Agent, or Firm*—Frishauf, Holtz, Goodman, Langer & Chick, P.C.

[57] ABSTRACT

The invention relates to an excimer lamp with a discharge chamber which holds a halogen-containing filling gas forming excimers under discharge conditions. Known excimer lamps have only a short burning life. In order to provide an excimer lamp with a long burning life, it is proposed according to the invention that the halogen content of the discharge chamber be a minimum of $1\times10^{-10}$ mol/cm$^3$ volume of the discharge chamber per cm$^2$ of the discharge chamber interior surface area. To manufacture such a long-life excimer lamp, the interior surfaces of the discharge chamber may be treated with a halogen-containing passivating gas prior to filling in the filling gas or the required amount of halogen can be included in the filing gas. The burning life of excimer lamps can also be extended by releasing halogen into a chamber in which it has become depleted, by exposing the discharge chamber to infrared radiation to release halogen taken up by the walls or by releasing halogen from a halogen reservoir disposed in the discharge chamber. In a device according to the invention suitable for extending the burning life of excimer lamps, at least one infrared lamp is provided which is disposed adjacent to the excimer lamp in such a manner that the infrared radiation emanating from the infrared lamp heats the discharge chamber.

13 Claims, 4 Drawing Sheets

LONG-LIFE HIGH POWERED EXCIMER LAMP WITH SPECIFIED HALOGEN CONTENT, METHOD FOR ITS MANUFACTURE AND EXTENSION OF ITS BURNING LIFE

BACKGROUND OF THE DISCLOSURE

The invention relates to an improved excimer lamp of the type with a discharge chamber usually of quartz or ceramic, and which holds a halogen-containing filling gas forming excimers under discharge conditions. The invention also relates to a method for the manufacture of a long-life excimer lamp; a method for extending the burning life of such an excimer lamp; and a device for practicing the latter method.

Excimer lamps are used for generating high-energy ultraviolet radiation. The excimer radiation is also described as silent electrical discharge. This is generated in a discharge chamber bound by dielectrics in which the filling gas forming the excimers is contained.

An excimer lamp of the specified type is known from EP-A1 0 547 366. In the excimer lamp described therein, a variety of noble gases are proposed as filling gases depending on the desired spectral composition of the radiation, for example, argon, krypton or xenon or noble gas mixtures, respectively, which, for example, contain chlorine or a chlorine-containing compound from which one or more chlorine atoms are expelled during the discharge.

No indications are given in EP-A1 547 366 as to the chlorine concentration to be used. In excimer lamps commercially available currently, the chlorine content is based on the chlorine content of the corresponding excimer lasers at a mixing ratio of chlorine to a noble gas or a noble gas mixture, respectively, of 1/1000. An excimer lamp of this type, for example, is described in the dissertation by Mr. Volker Shorpp entitled "The Dielectrically Inhibited Noble Gas-Halogen-Excimer Discharge: A New Type of Ultraviolet Radiation Source," University of Karlsruhe, 1991.

From EP-A2 0 521 553 an excimer lamp is known which is developed as a planar flatform lamp. The discharge chamber contains a halogen-containing noble gas filling, whereby the partial pressure of the halogen is between 0.05% and 5% of the partial pressure of the noble gas. The known excimer lamp is characterized by a high radiation intensity.

In excimer lamps known until now, the maximally adjustable ultraviolet radiation intensity already decreases within the first 300 hours of operation. The drop in the ultraviolet radiation intensity is typically greater than 50% of the initial radiation intensity.

An attempt to extend the burning life of a lamp of this type is described in EP-A1 607 960. Therein an excimer lamp is described which features a discharge chamber which is sealed in a gas-proof fashion and is filled with a suitable filling gas. In order to extend the burning life of the lamp, EP-A 1607960 teaches the proposed elimination of gaseous impurities in the filling gas and to that end provide a "getter" which may be disposed inside the discharge chamber or in connection with it. However, it has been demonstrated that eliminating filling gas impurities is not sufficient for a marked increase in-burning life.

It is therefore an object of the present invention to provide an excimer lamp with a long burning life as well as to provide a method for manufacturing such an excimer lamp. A further object of the invention is to provide a method for extending the burning life of excimer lamps and a device suitable to practice this method.

SUMMARY OF THE INVENTION

The object of the invention is attained with an improvement to the above mentioned excimer lamp by using a halogen content in the discharge chamber of at least of $1\times10^{-10}$ mol/cm$^3$ volume of the chamber for each cm$^2$ of area of the interior surface of the discharge chamber and, simultaneously, being set as a function of the maximum power density of the lamp, expressed in the unit "watt per cm of lamp length," at a value in the range of $1\times10^{-7}$ mol/cm$^3$ to $1\times10^{-5}$ mol/cm$^3$ per unit of power density.

BRIEF DESCRIPTION OF THE DRAWINGS

In the following, the invention is explained in greater detail on the basis of embodied examples and the patent drawing. In the drawings the following are shown in detail.

Figure 1:
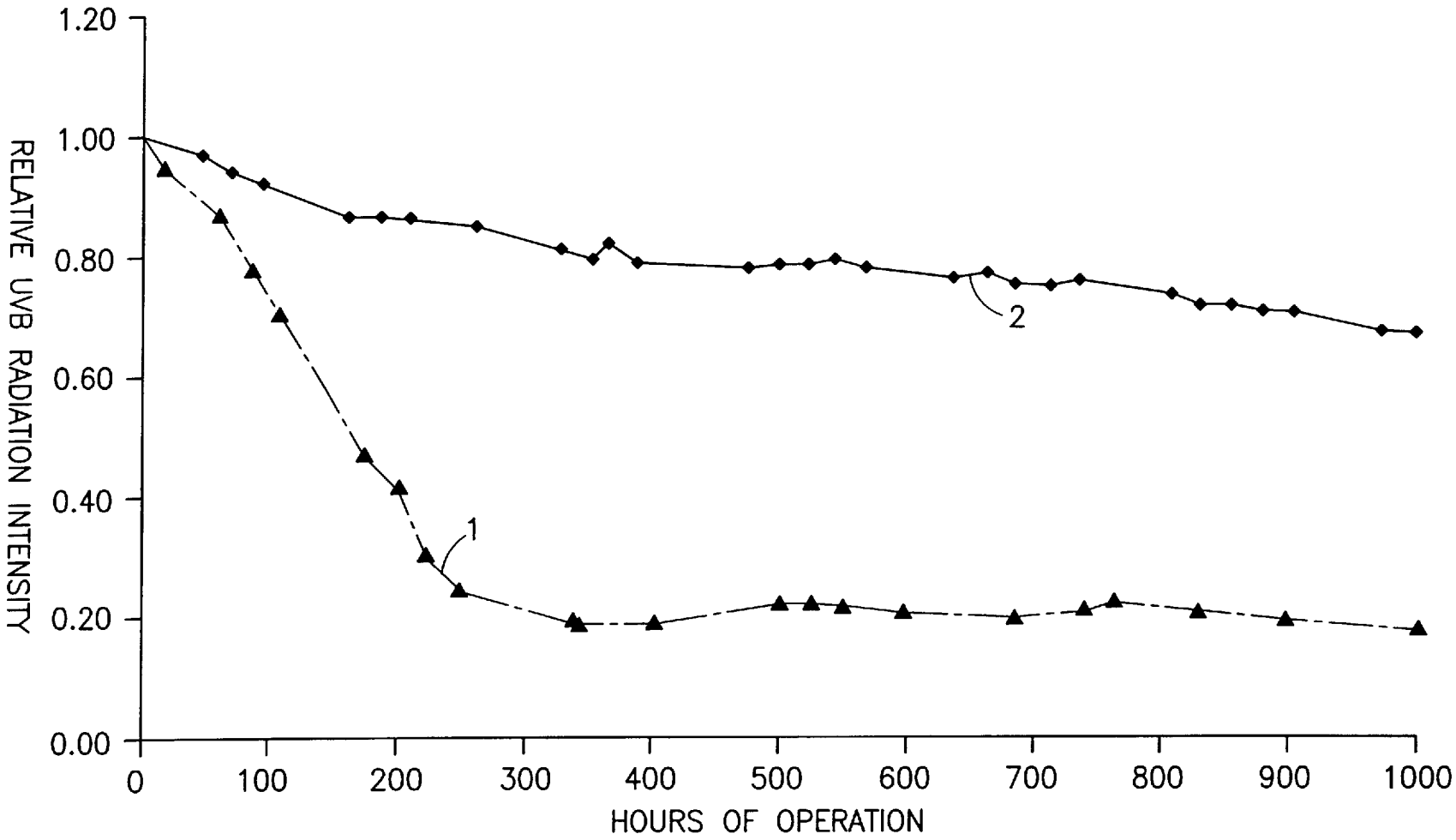
FIG. 1: a creep diagram for various XeCl excimer lamps.
Figure 2:
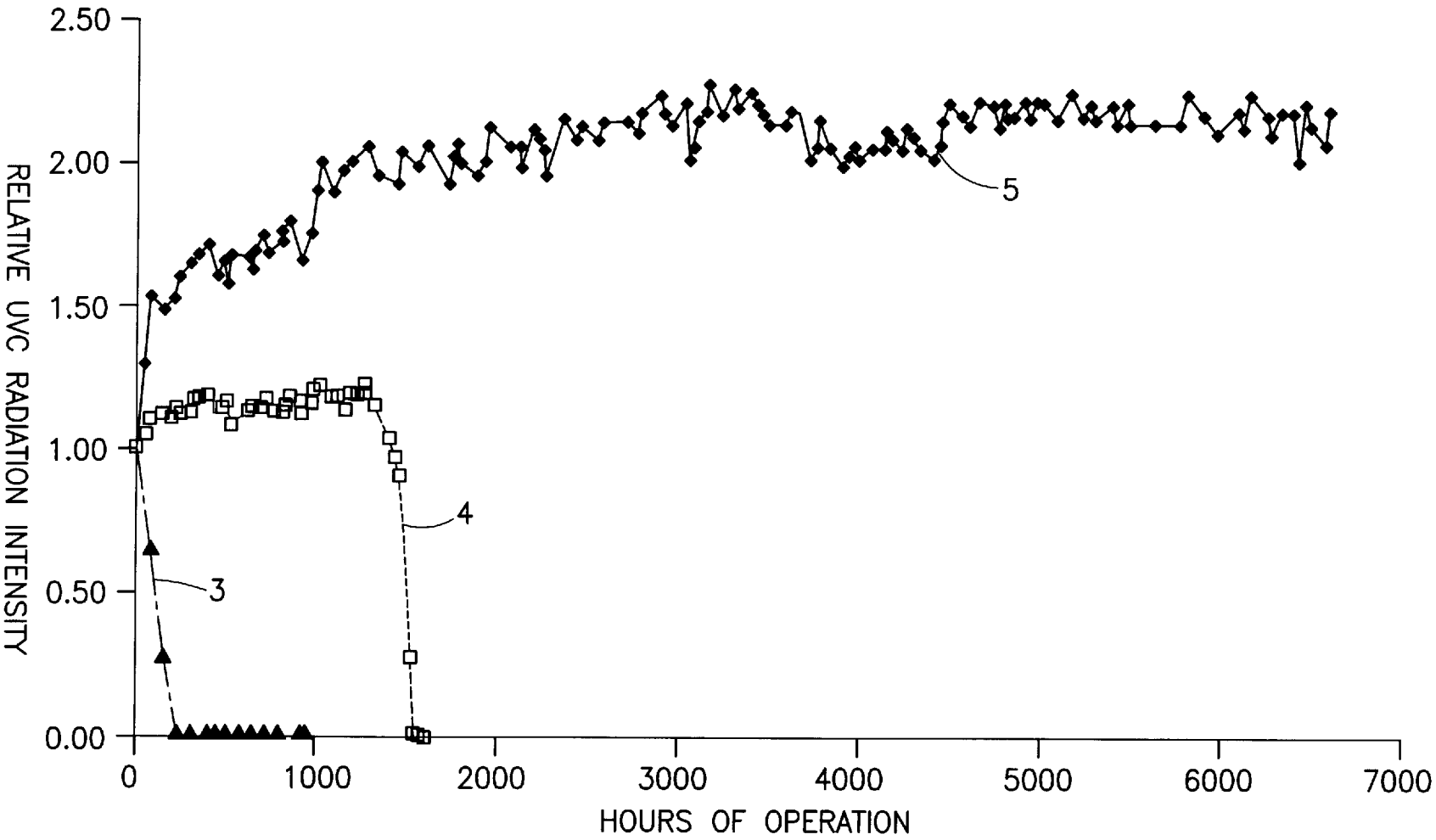
FIG. 2: a creep diagram for KrCl excimer lamps with high power.
Figure 3:
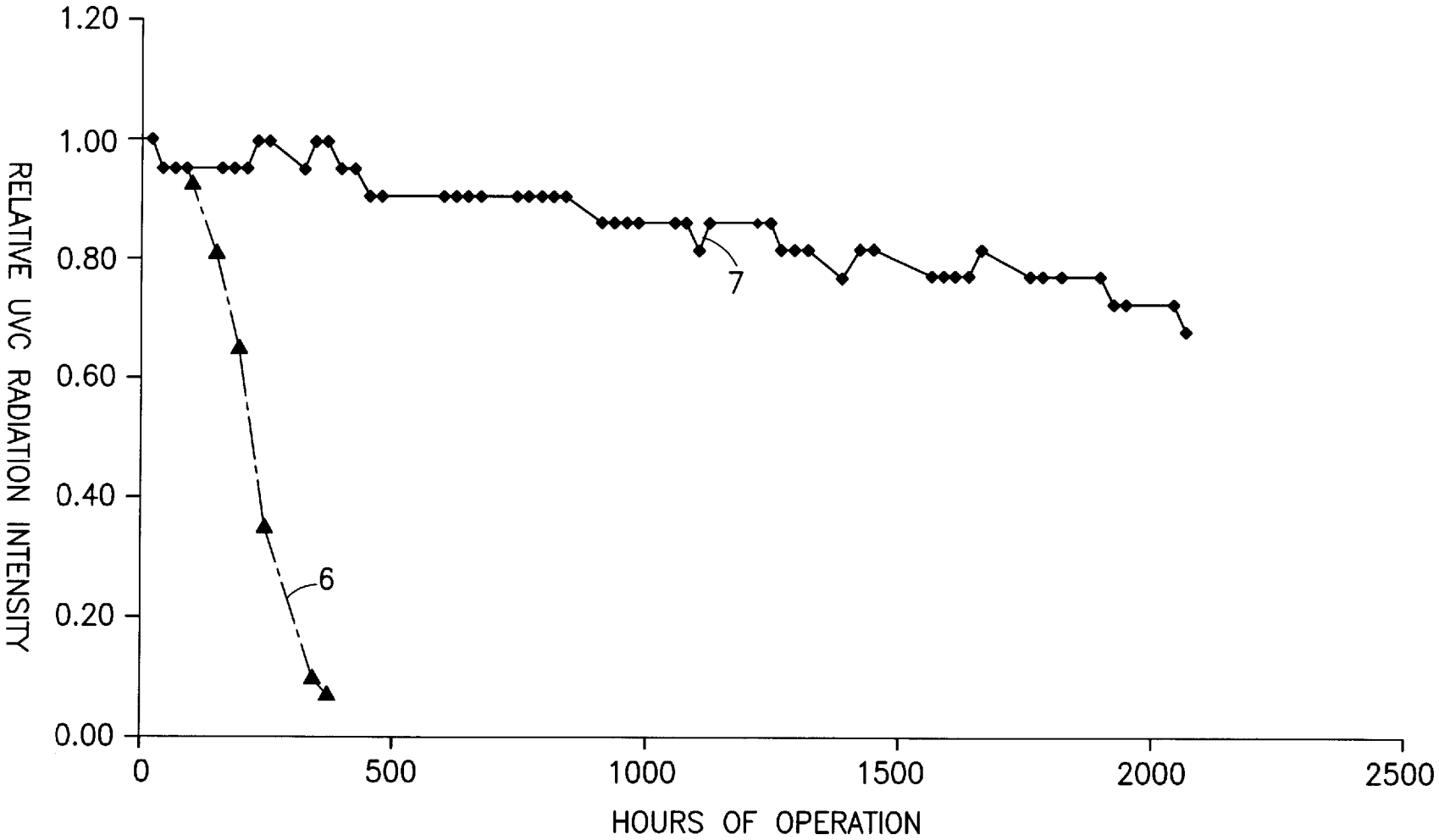
FIG. 3: a creep diagram for KrCl excimer lamps with low power.

In the diagrams according to FIGS. 1 to 3, the hours of operation are entered on the X-axis and the relative radiation intensity on the Y-axis.

DETAILED DESCRIPTION

Contrary to the teachings in EP-A1 607 960, it was discovered that impurities in the filling gas are not primarily responsible for a decrease in the ultraviolet radiation intensity in the known excimer lamps, but rather it is the depletion of halogen from the filling gas.

In the following, "halogen" refers to fluorine, chlorine, bromine and iodine as well as mixtures of these gases; "noble gas" refers to helium, neon, argon, krypton and xenon as well as mixtures of these gases. If the filling gas contains compounds which release halogens under discharge conditions, the halogen concentrations actually released under discharge conditions are of significance for determining the amount of halogen. It has been demonstrated that the releasing of halogen essentially depends on the power density at which the lamp is operated.

The present invention provides an improvement to known excimer lamps in order to extend their life by restraining the drop in UV intensity caused by the loss of halogen. The loss of halogen can be the result of a reaction of the halogen with the interior surfaces of the discharge chamber. The boundary walls of the discharge chamber can, for example, consist of quartz glass or of a ceramic material. Although the surface reaction of the halogen can be avoided by means of a suitable modification of the interior surfaces delimiting the discharge chamber, such measures are labor-intensive and expensive and, moreover, the modifications made are often not sufficiently resistant to the discharge. For example, protective layers which were applied may flake off.

Surprisingly, it was discovered that an extension of the burning life can be achieved by an initially increased concentration of halogen in the filling gas as compared with the excimer lamps known currently. That this result is possible can be attributed to the fact that the consumption of halogen on the interior surface of the discharge chamber is not a constant or continuous consumption of halogen, but rather with an increasing supply of halogen in the filling gas one can observe a saturation of the surface reaction. The amount of halogen necessary to reach saturation of the surface reaction plus the amount of halogen required within the discharge chamber sufficient for excimer discharge, is designated in the following as the saturation concentration. Thus, the saturation concentration depends not only on the operating temperature of the excimer lamp and its power, but also in particular on the size or area of the interior surface of the discharge chamber.

This invention is based in part on the discovery that the saturation concentration per $cm^2$ of the interior surface of the discharge chamber is at a halogen content of at least $1\times10^{-10}$ mol/$cm^3$ of the chamber volume. This halogen content can be measured in the filling gas prior to the occurrence of surface reactions with halogen, e.g. prior to the initial operation of the lamp. In the case in which the interior surfaces of the discharge lamp have already been charged with halogen or subsequent to an initial operation of the lamp, the halogen content in the discharge chamber can be determined by adding any halogen bonded to or in the interior surface of the discharge chamber to the halogen content of the filling gas. The determination of the halogen content bonded to or in the interior surface of the discharge chamber can, for example, take place through release of the halogen in the discharge chamber by means of a suitable temperature treatment. However, this halogen content can also be determined via chemical or spectroscopic methods. In doing so, however, it must be noted that such halogen, which might additionally be present inside the material of the walls delimiting the discharge chamber, is not taken into account. For example, synthetic quartz glass often contains a certain chlorine content which is a function of the manufacturing method. If the indicated saturation concentration of halogens in the discharge chamber can be permanently maintained, a decrease in the radiation intensity is prevented totally or partially over time. A concentration of halogen exceeding the actually sufficient saturation concentration has no damaging effects on the burning life behavior. However, it influences the irradiation characteristic of the lamp and reduces its maximum power density. The halogen concentration to be set, however, also depends on the maximum power density of he lamp. Thus, an additional proportioning rule must be observed, namely that the halogen content in the discharge chamber is set as a function of the maximum power density of the lamp, expressed in the unit "watt per cm of lamp length," at a value in the range of $1\times10^{-7}$ mol/$cm^3$ to $1\times10^{-5}$ mol/$cm^3$ per unit of power density.

The indicated interrelationship between the power density and the appropriate halogen content of the discharge chamber has proven to be basically linear up to a power density of approximately 200 W/cm of length of lamp. It can be assumed that this interrelationship is also valid with even higher power densities, for example, with power densities around 400 W/cm. In this context, length of lamp refers only to the length of the lamp actually illuminated.

Although concentrations of halogen exceeding the actually sufficient saturation concentration have no damaging effects on the burning life properties, excess concentrations effect the radiation characteristic of the lamp and reduces its maximum power density.

Workers in the art would have no problem proceeding from the teaching herein, to optimize the halogen content with respect to the desired lamp characteristics including actual lamp power and operating temperature. For example, in the case where a long burning life for the lamp is preferred to high power density, the halogen concentration can be adjusted to a relatively high level. And, vice versa, if a high power density is more important than a particularly long burning life, the halogen concentration can be kept relatively low.

In standard excimer lamps, the specified saturation concentration corresponds approximately to a mixing ratio of halogen:noble gas of 1:50 to 1:500. These mixing ratios are only given as reference points to facilitate orientation. In this connection it is specifically emphasized that not the mixing ratio but the absolute halogen content, in terms of the size of the interior surface and the volume of the discharge chamber, is decisive for the excimer lamp according to the invention. As a result, possible buffer gases in the discharge chamber, which can also be noble gases, are not taken into consideration.

Particularly successful is an excimer lamp in which the halogen content of the discharge chamber is in the range of about $1\times10^{-10}$ mol/$cm^3$ to about $1\times10^{-8}$ mol/$cm^3$ per $cm^2$ of its interior surface area. The upper limit follows from the decreasing efficiency of the lamp with increasing halogen content. Halogen possesses a high electro-negativity and generally a lower excitation probability with respect to the noble gas. Therefore, as is known in the art, it catches a relatively large quantity of electrons and the lamp can only be lit with difficulty with a high chlorine content. On the other hand, with an increase in the power density of the excimer lamp the filament density increases and, as a result, the halogen content in its atomic form. Atomic halogen, however, attaches particularly easily to the boundary walls of the discharge chamber. The specified upper limit for halogen concentration is thus of particular significance for excimer lamps with a high power density of around 100 W per cm of lamp length, whereas for excimer lamps with lower power density—irrespective of the above proportioning rule with regard to power density—this upper limit can be reduced somewhat for the above cited reasons.

An excimer lamp in which the filling gas contains chlorine or a compound releasing chlorine under discharge conditions has a particularly long burning life. A suitable chlorine-containing filling gas contains, for example, HCl with 2% $Cl_2$ and a noble gas, such as krypton, xenon or argon.

An excimer lamp in which a halogen-containing reservoir is disposed in the discharge chamber, whereby the concentration of halogen in the reservoir exceeds that in the filling gas, has proved particularly advantageous. The halogen in the halogen reservoir is separated from the filling gas of the discharge chamber. If the halogen content drops below a given lower limit, the reservoir can be opened automatically or manually, thus releasing the halogen contained in it to the discharge chamber. Hereby, the halogen content of the reservoir is calculated such that through release, the concentration of halogen in the discharge chamber can be increased, for example, so that the desired concentration of halogen in the discharge chamber can be obtained. A suitable halogen content of the reservoir thus follows simply from the difference between the concentration at the lower limit and the desired concentration as well as the volume of the discharge chamber. The reservoir has a relatively low volume, compared with the volume of the discharge chamber. The halogen concentration in the reservoir is thus relatively high. The reservoir can, for example, be designed in the form of a chamber made of quartz glass or a ceramic material which, upon reaching the mentioned lower limit of the concentration, is broken. The lower limit of the concentration can be determined on the basis of intensity measurements of the excimer radiation.

With respect to the method for manufacturing a long-life excimer lamp, the above indicated object is met according to the invention proceeding from the initially specified method, by treating the interior surfaces of the discharge chamber with a halogen-containing passivating gas prior to filling in the filling gas.

It was determined that a higher halogen content in the filling gas of the discharge chamber was not required when the interior surfaces of the discharge chamber had been treated with halogen prior to filling in the filling gas. This pretreatment with halogen so to speak "passivated" the interior surfaces of the discharge chamber. Through the passivation the interior surfaces are saturated with halogen and thus, when operating the excimer lamp later on, a further consumption of halogen from the filling gas due to absorption in, adsorption on or chemical reaction with the boundary walls of the discharge chamber, is prevented or reduced.

This passivation is a modification of the interior surface of the discharge chamber which can be performed relatively easily. For example, it can take place simply by rinsing or flushing the discharge chamber with halogen.

The method according to the invention has proven particularly effective with respect to an extension of the burning life of excimer lamps in which chlorine or a compound releasing chlorine under discharge conditions is employed, if chlorine is used for the passivation.

The halogen content of the passivating gas per each $cm^2$ of area of the interior surface of the discharge chamber is advantageously at least $1\times10^{-10}$ mol/$cm^3$, provided that it is selected to be at least as large as the halogen content in the filling gas. In this connection, the term "halogen content" is understood as the concentration of halogen with respect to the volume of the discharge chamber. The passivation can be performed with discharge chamber walls made of quartz glass at an increased temperature of up to 1000° C.; and with ceramic walls at even higher temperatures.

The present invention also provides a method for extending the burning life of an excimer lamp, by exposing the discharge chamber to infrared radiation or by releasing halogen from a halogen reservoir disposed in the discharge chamber.

In the first alternative of the method, the walls delimiting the discharge chamber are heated preferably using infrared radiation. In this connection, the walls generally are made of quartz glass. It was discovered that the heating will reverse a previously occurring depletion of halogen from the filling gas. It was previously assumed that halogen is fully absorbed by the quartz glass or forms a stable chemical compound with the silicon of the quartz glass. The inventors hereof discovered that the take-up of halogen by the walls of the lamp is reversible and that, by reversing the take-up and releasing the halogen, the burning life of the lamp is extended.

More specifically, by exposing the excimer lamp to infrared radiation either during operation or during a break period when the excimer lamp is switched off, the filling gas can be regenerated with respect to its halogen content. The loss of halogen that has occurred has so far been shown to be reversible. Surprisingly, the reversibility of the loss of halogen is concomitant with an extension of the burning life of the excimer lamp. Thus, the temporary loss of halogen within the discharge chamber and operation with low halogen content do not result in irreversible damage to the excimer lamp.

For heating by exposure to infrared radiation the excimer lamp can, for example, be placed in an oven, or it is exposed to radiation emitted by an infrared lamp.

In an alternative of the method according to the invention, the halogen is released from a halogen reservoir disposed in the discharge chamber. The concentration of the halogen in the reservoir is set higher than that in the filling gas. The additional halogen from the reservoir can compensate for a loss of halogen in the discharge chamber. If the halogen content drops below a given lower limit, the reservoir can be opened automatically or manually, thus releasing the halogen contained in it to the discharge chamber. With respect to the design of the halogen reservoir, its halogen content and the determination of the lower limit of the concentration, reference is made to the aforementioned explanations.

A method has proved particularly advantageous in which the discharge chamber is heated to a temperature in the range of 400° C. to 1000° C., preferably by means of infrared radiation. This temperature range applies to a discharge chamber with boundary walls of quartz glass. If the boundary walls are made of ceramic material, such as $Al_2O_3$, temperatures above 1000° C. are more favorable. Such a method has proven particularly effective with chlorine-containing filling gas.

With respect to the device for practicing the method for extending the burning life of an excimer lamp, the above indicated object is met according to the invention by providing at least one infrared lamp which is disposed adjacent to the excimer lamp in such a manner that the infrared radiation emanating from the infrared lamp heats the discharge chamber.

Based on the adjacent disposition of excimer lamp and infrared lamp, the above explained method for extending the burning life of the excimer lamp can be applied at any time in a simple fashion. For this, only the infrared lamp need be switched on. In doing so, the infrared radiation is directed at the discharge chamber and heats its boundary walls. Thus the halogen taken-up on the walls is released.

As an infrared source, an oven is also basically suitable. Advantageously, the infrared source lamp is provided with a reflector which directs the infrared radiation at the discharge chamber and thus prevents undesired infrared radiation in other directions.

In a preferred embodiment of the device, the length of the infrared lamp or the total length of all infrared lamps corresponds approximately to the length of the discharge chamber. This enables the halogen to be effectively released across the total length of the discharge chamber. Advantageously, the infrared lamp or infrared lamps run parallel to the discharge chamber of an excimer lamp.

Particularly successful is a device in which at least one infrared lamp and the excimer lamp are electrically connected with each other in such a manner that after a determinable time interval prior or subsequent to switching on the excimer lamp, the infrared lamp is switched on. This embodiment of the device has the advantage that the release of the halogens from the interior surfaces delimiting the discharge chamber takes place in a reproducible manner. In doing so, the excimer lamp and the infrared lamp can be switched on simultaneously, e.g. the above mentioned interval can also be 0.

Referring to the drawings, FIG. 1 shows the burning life behavior of a XeCl module lamps. They generate a power density of 25 W/cm of length of lamp. The filling pressure of the filling gas in the discharge chamber is 750 mbar. Argon as buffer gas contributes approximately 300 mbar to this internal pressure. In this embodiment, the discharge chamber in these lamps is formed by the clearance between two quartz glass tubes which run coaxially with respect to each other. The outer diameter of the discharge chamber is 27 mm, the inner diameter 16 mm and the length 343 mm.

The curve designated with the reference number 1 reflects the burning life behavior of a XeCl module lamp commercially available currently. In this lamp the mixing ratio of xenon to chlorine is approximately 1000:1. The absolute chlorine content in the discharge chamber is below $1\times10^{-10}$ mol/cm$^3$ per cm$^2$ of the interior surface of the discharge chamber; more precisely at approximately $3\times10^{-11}$ mol/cm$^3$. The interior surface of the discharge chamber is approximately 470 cm$^2$. The indication regarding concentration refers in this context to the volume of the discharge chamber.

From the progression of curve 1 it is apparent that immediately upon using the lamp, a rapid drop in the relative radiation intensity of the XeCl module lamp takes place which, after approximately 300 hours of operation, terminates in a final value which is in the range of 20% of the original radiation intensity. From this relatively low level of radiation intensity, a further deterioration of the radiation intensity can no longer be observed with the known excimer lamps. The drop in radiation intensity can be attributed, among other reasons, to a depletion of chlorine in the filling gas.

The progression of the curve designated with the reference number 2 reflects the burning life behavior of a XeCl module lamp in which the chlorine content of the discharge chamber is quintupled compared to the previously described known excimer lamp. The mixing ratio of xenon to chloride consequently is approximately 200:1. From the above indications a chlorine content of $1.5\times10^{-10}$ mol/cm$^3$ per cm$^2$ of the interior surface of the discharge chamber results. The power density is approximately 30 watts per cm of illuminated length of lamp. Apart from that, the examined XeCl module lamps are identical. During the operation of the XeCl module lamp according to the invention, the chlorine attaches to the interior walls of the discharge chamber; thus, in the filling gas, the chlorine content slowly decreases and, in doing so, can drop below the value of, for example, $5\times10^{-11}$ mol/cm$^3$ cm$^2$ of the interior surface.

The burning life behavior of the XeCl module lamp according to the invention is characterized by an only slight and particularly slow decrease of the UVB radiation intensity over time. After approximately 1000 hours of operation, the relative UVB radiation intensity has only decreased by approximately 20%. However, it cannot be determined from curve 2 if the radiation intensity results in a final value.

A similar result with respect to burning life behavior results from the creep diagrams of KrCl module lamps represented in FIG. 2. These generate a power density of 25 W/cm of length of lamp. The filling pressure of the filling gas in the discharge chamber is 350 mbar. The discharge chamber in these lamps is also formed by the clearance of two quartz glass tubes which run coaxially with respect to each other. The outer diameter of the discharge chamber is 27 mm, the inner diameter 16 mm and the length 343 mm.

Here curve 3 is a creep curve as it is generally measured with a KrCl module lamp according to the state of the art. The mixing ratio of krypton to chlorine is approximately 1000:1. The absolute chlorine content in this lamp is identical to the one in the above described known XeCl module lamp. Also here, immediately subsequent to use of the lamp, a relatively significant decrease of the UVC radiation intensity can be observed which ends after approximately 300 to 400 hours of operation at a low final value which is below 10% of the original radiation intensity.

Curves 4 and 5 show results for to KrCl module lamps which differ only with respect to the mixing ratio of the filling gas. They generate a power density of 25 W/cm of length of lamp. Here, a buffer gas is not present. In the excimer lamp according to curve 4, the initial mixing ratio of krypton:chlorine is 100:1, in the creep curve 5, 50:1. The last mentioned mixing ratio corresponds to a chlorine content of approximately $6\times10^{-10}$ mol/cm$^3$ per cm$^2$ of the interior surface of the discharge chamber. The interior surface of the discharge chamber is approximately 470 cm$^2$.

The progression of each creep curve 4 and 5 is marked by an initial light increase in the UVC radiation intensity, which terminates after several hours of operation in a high and constant final value, which is dependent on the chlorine concentration. A decrease in radiation intensity could not be observed with the KrCl module lamp according to the invention even after 1000 hours of operation.

In the creep curves according to FIG. 3, the burning life behavior of KrCl excimer lamps with the relatively low power of 30 W is illustrated. The illuminated length of the lamp is 10 cm. It has been demonstrated that with increasing power density the loss of chlorine increases. This is based on the already mentioned effect according to which with increasing filament density the content of atomic chlorine increases which then, in turn, reacts at the interior walls of the discharge chamber and thus is eliminated from the filling gas.

The creep curve designated with the reference number 6 again reflects the typical burning life progression of commercially available excimer lamps, whereby subsequent to an initial heavy drop in the UVC radiation intensity after approximately 350 hours of operation, a final value for the radiation intensity on a low level is achieved.

In the KrCl excimer lamp according to the invention according to FIG. 3, curve 7, the initial mixing ratio of chlorine:krypton in the filling gas is 1:1000. The particularly excellent burning life behavior of the lamp evident from FIG. 3 is the result of a passivation of the interior surface of the discharge chamber prior to filling the chamber with the filling gas.

To perform a passivation of the interior surface of the discharge chamber, the latter was evacuated, then filled with chlorine at ambient temperature which, after approximately 3 seconds, was again pumped off. Subsequently, the discharge chamber was filled with filling gas and sealed in a gas-proof fashion.

Due to the passivation of the interior surfaces of the discharge chamber, the KrCl excimer lamp according to the invention showed only a slight decrease in the UVC radiation intensity during the test time of approximately 2000 hours.

In a further embodiment the KrCl excimer lamp, whose burning life behavior is reflected by creep curve 3 and in which the mixing ratio is krypton:chlorine=1000:1, was exposed to a thermal treatment at a temperature of 750° C. over a period of time of one hour. As a result, an increase of the relative UVC radiation intensity of the excimer lamp from below 10% of the initial value to 80% of this value was observed.

Figure 4:
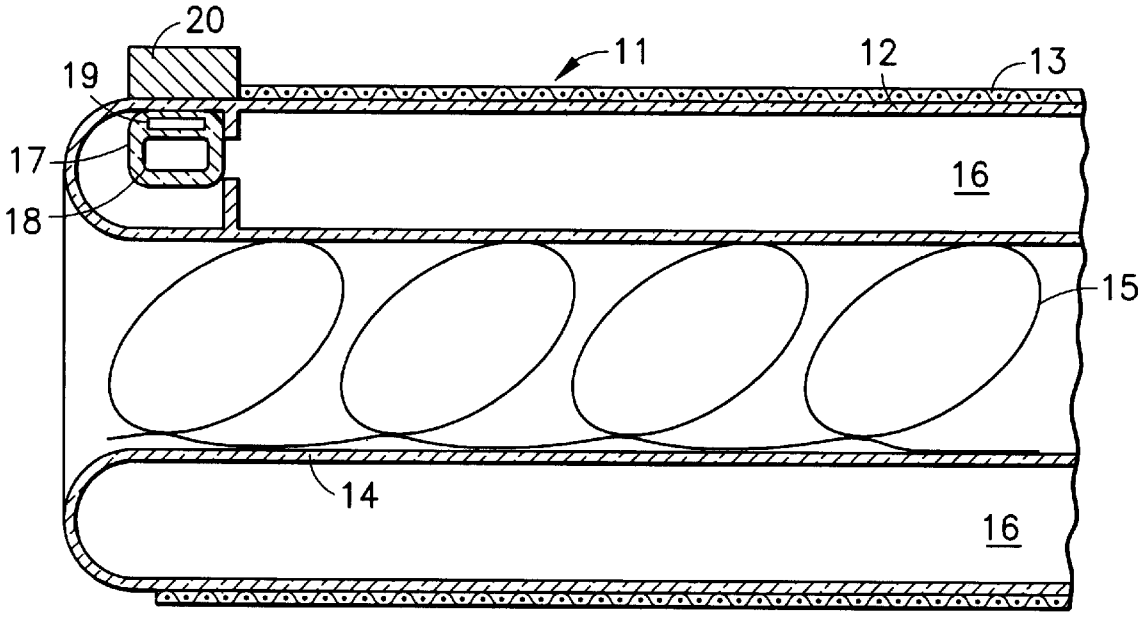
FIG. 4: a section from an excimer lamp with a halogen reservoir in the discharge chamber in longitudinal view schematically represented.

The excimer lamp schematically represented in FIG. 4 is referred to in its entirety with reference number 11. The excimer lamp 11 consists of an outer quartz glass tube 12, which is covered with a metallic net 13 on its jacket surface, which forms the outer electrode of the excimer lamp 11, and an inner quartz glass tube 14 which is disposed so as to be coaxial with the outer quartz glass tube 12 and against whose inner wall a metallic spiral 15 rests which forms the inner electrode of the excimer lamp 11. The annular gap between the outer quartz glass tube 12 and the inner quartz glass tube 14 corresponds to the discharge chamber 16 of the excimer lamp 11. The volume of the discharge chamber 16 is approximately 470 $cm^3$. The power density is at 30 watts per cm illuminated length of lamp. The filling gas in the discharge chamber 16 consists of KrCl in a mixing ratio of krypton:chlorine=1000:1.

In the discharge chamber 16 a quartz glass capsule 17 filled with chlorine is disposed. The wall of capsule 17 is scratched and provided in this manner with a desired breaking point 18. The chlorine content of capsule 17 is set such that after breaking capsule 17 the chlorine content in the discharge chamber 16 is increased, namely, by $1\times10^{11}$ $mol/cm^3$ per each $cm^2$ of the interior surface of discharge chamber 16.

In the wall of capsule 17 a metal component 19 is embedded and shielded from discharge chamber 16. The metal component 19 together with the capsule 17 is maintained in an upper position by means of magnet 20. If the capsule 17 is dropped from this position, e.g. by removing or switching off the magnet, the capsule 17 breaks and the chlorine contained in it escapes into the discharge chamber 16. In this manner, the chlorine content in discharge chamber 16 can be regenerated. To determine the best point in time for regenerating, the intensity of a characteristic emission wavelength of the excimer lamp 11 is measured with an ultraviolet sensor. If the lower limit of intensity is surpassed, this is visually indicated and the magnet 20 is then removed. In an alternative embodiment, in which magnet 20 is developed as an electromagnet, magnet 20 is automatically switched off when the lower limit of the intensity is surpassed and thereby the chlorine from capsule 17 is released into discharge chamber 16.

The above is illustrative of the invention, but not intended to limit the scope of the invention. It will be appreciated that various modifications and changes may be made without departing from the spirit and scope of the present invention.

What is claimed is:

1. In an excimer lamp with a discharge chamber having an interior surface and in which a halogen-containing filling gas forming excimers under discharge conditions is contained, the improvement wherein the halogen content of the discharge chamber is at a minimum $1\times10^{-10}$ mol per $cm^3$ of the volume of the discharge chamber and per $cm^2$ of the area of the interior surface of the discharge chamber and, simultaneously, is set as a function of the maximum power density of the lamp, expressed in units of watt per cm of lamp length, at a value in the range of $1\times10^{-7}$ mol per $cm^3$ to $1\times10^{-5}$ mol per $cm^3$ of the volume of the discharge chamber and per said unit of maximum power density.

2. The excimer lamp according to claim 1, wherein the halogen content of the discharge chamber is in the range of $1\times10^{-10}$ $mol/cm^3$ to $1\times10^{-8}$ $mol/cm^3$ of the volume of the discharge chamber per $cm^2$ of the interior surface of the discharge chamber.

3. The excimer lamp according to claim 1, wherein the halogen in the filling gas is chlorine or a compound releasing chlorine under discharge conditions.

4. The excimer lamp of claim 1 further comprising a reservoir disposed in the discharge chamber said reservoir containing a concentration of the halogen which exceeds the concentration of the halogen in the filling gas.

5. The excimer lamp of claim 4 wherein the halogen in the filling gas of the discharge chamber is chlorine or a compound releasing chlorine under discharge conditions.

6. In a method for the manufacturing of a long-life excimer lamp having a discharge chamber with an interior surface and in which a halogen-containing filling gas forming excimers under discharge conditions is contained, the improvement wherein the halogen content of the discharge chamber is at a minimum of $1\times10^{-10}$ mol per $cm^3$ volume of the discharge chamber per $cm^2$ of the area of the interior surface of the discharge chamber and, simultaneously, is set as a function of the maximum power density of the lamp, expressed in units of watt per cm of lamp length, at a value in the range of $1\times10^{-7}$ mol per $cm^3$ to $1\times10^{-5}$ mol per $cm^3$ of the volume of the discharge chamber and per said unit of the maximum power density, which method includes filling the discharge chamber with a halogen containing filling gas, the improvement comprising passivating the interior surfaces of the discharge chamber by contacting the interior surfaces with a halogen-containing gas prior to filling the chamber with the filling gas.

7. In the method for the manufacture of a long-life excimer lamp according to claim 6, wherein the halogen is chlorine or a compound releasing chlorine under discharge conditions, and the step of passivating the interior surfaces of the discharge chamber comprises treating the surfaces with a chlorine containing gas.

8. A method for extending the burning life of an excimer lamp which has a discharge chamber with chamber inner walls holding a halogen-containing filling gas forming excimers under discharge conditions, comprising the steps of releasing halogen from a halogen reservoir disposed in the discharge chamber.

9. A method for extending the burning life of an excimer lamp which has a discharge chamber with chamber inner walls holding a halogen-containing filling gas forming excimers under discharge conditions, comprising the steps of heating the discharge chamber inner walls to a temperature in the range of 400° C. to 1000° C. by exposure to infrared radiation, thereby to release any halogen taken up by the chamber inner walls into the discharge chamber.

10. The method according to claim 8, wherein the reservoir is a glass container and the step of releasing the halogen comprises breaking the glass container.

11. A device for extending the burning life of an excimer lamp having a discharge chamber with inner walls, by heating the inner walls to release hydrogen taken up by the inner wall, comprising one or more infrared lamps disposed adjacent to the excimer lamp in such a manner that the infrared radiation emanating from the infrared lamp heats the discharge chamber walls.

12. The device according to claim 11, wherein the length of the infrared lamp or the total length of all infrared lamps corresponds approximately to the length of the discharge chamber.

13. The device according to one of the claim 11, wherein at least one infrared lamp and the excimer lamp are electrically connected with each other in such a manner that after a determinable time interval prior or subsequent to switching on the excimer lamp the infrared lamp is switched on.

* * * * *